US010378265B2

(12) United States Patent
Watanabe

(10) Patent No.: US 10,378,265 B2
(45) Date of Patent: Aug. 13, 2019

(54) DOOR OPENING AND CLOSING DEVICE

(71) Applicant: MITSUI KINZOKU ACT CORPORATION, Kanagawa (JP)

(72) Inventor: Yasuyuki Watanabe, Kanagawa (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 78 days.

(21) Appl. No.: 15/213,016

(22) Filed: Jul. 18, 2016

(65) Prior Publication Data

US 2017/0044815 A1 Feb. 16, 2017

(30) Foreign Application Priority Data

Aug. 10, 2015 (JP) ..... 2015-158416

(51) Int. Cl.
*E05F 15/70* (2015.01)
*E05F 15/63* (2015.01)
(Continued)

(52) U.S. Cl.
CPC ..... *E05F 15/70* (2015.01); *E05B 81/00* (2013.01); *E05F 15/614* (2015.01); *E05F 15/63* (2015.01);
(Continued)

(58) Field of Classification Search
CPC ..... E05Y 2900/546; E05Y 2900/531; E05Y 2400/36; E05Y 2400/32; E05Y 2400/44;
(Continued)

(56) References Cited

U.S. PATENT DOCUMENTS 4,916,861 A * 4/1990 Schap ..... E05F 15/632 296/155
5,563,483 A * 10/1996 Kowall ..... E05B 81/14 318/266
(Continued)

FOREIGN PATENT DOCUMENTS

CN 1802487 A 7/2006
CN 1811116 A 8/2006
(Continued)

OTHER PUBLICATIONS

First Office Action issued in corresponding Chinese Patent Application No. 201610621297.2, dated Aug. 1, 2017 (With partial English Machine Translation).
(Continued)

*Primary Examiner* — Justin B Rephann
(74) *Attorney, Agent, or Firm* — McDermott Will & Emery LLP

(57) ABSTRACT

A door opening and closing device includes a motor that outputs driving force causing a back door of a vehicle to be opened or closed, and a controller that controls the motor. The controller executes automatic opening and closing control for automatically opening or closing the back door by the motor, and if the controller detects a stop command causing the back door to be stopped when the automatic opening and closing control is being executed, the controller decreases a target velocity of the back door at a predetermined deceleration α1 until the back door stops.

4 Claims, 14 Drawing Sheets

(51) Int. Cl.
*E05B 81/00* (2014.01)
*E05F 15/614* (2015.01)
*E05F 15/71* (2015.01)

(52) U.S. Cl.
CPC ..... *E05F 15/71* (2015.01); *E05Y 2201/434* (2013.01); *E05Y 2201/72* (2013.01); *E05Y 2400/302* (2013.01); *E05Y 2400/36* (2013.01); *E05Y 2400/40* (2013.01); *E05Y 2900/546* (2013.01)

(58) Field of Classification Search
CPC ..... E05Y 2400/554; E05Y 2400/564; E05F 15/70; E05F 15/63; E05F 15/40; E05F 15/41; E05F 15/00; B60J 5/10
See application file for complete search history.

(56) References Cited

U.S. PATENT DOCUMENTS 5,851,049 A * 12/1998 Squire ..... E05F 15/49 296/146.4
5,851,050 A * 12/1998 Squire ..... E05F 15/49 296/146.4
5,982,126 A * 11/1999 Hellinga ..... B60J 5/06 318/286
5,986,420 A * 11/1999 Kato ..... E05F 15/619 318/1
6,185,868 B1 * 2/2001 Kato ..... E05F 15/627 192/35
6,293,050 B1 * 9/2001 Johnk ..... E05F 1/1091 49/276
7,698,855 B2 * 4/2010 Imai ..... E05F 15/659 296/155
7,808,197 B2 * 10/2010 Kimura ..... B60J 5/10 296/146.4
2001/0022049 A1 * 9/2001 Clark ..... B60J 5/06 49/360
2003/0218357 A1 * 11/2003 Mitsui ..... E05F 15/63 296/146.8
2003/0222610 A1 * 12/2003 Whinnery ..... G05B 19/232 318/362
2003/0222614 A1 * 12/2003 Whinnery ..... G05B 19/232 318/461
2004/0016180 A1 * 1/2004 Hellinga ..... E05F 1/1091 49/345
2004/0172883 A1 9/2004 Rogers et al.
2006/0137136 A1 * 6/2006 Imai ..... E05F 15/632 16/52
2006/0164029 A1 * 7/2006 Suzuki ..... E05F 15/42 318/283
2006/0181108 A1 * 8/2006 Cleland ..... E05F 15/43 296/146.4
2007/0051046 A1 3/2007 Yoshida
2007/0063527 A1 * 3/2007 Ueda ..... E05F 15/42 296/55
2007/0296242 A1 * 12/2007 Frommer ..... E05F 15/43 296/146.4
2008/0001563 A1 * 1/2008 Kimura ..... B60J 5/10 318/280
2008/0061719 A1 * 3/2008 Warren ..... E05F 15/611 318/14
2008/0178422 A1 * 7/2008 Imai ..... E05F 15/632 16/57
2009/0030579 A1 * 1/2009 Takehisa ..... E05F 15/76 701/49
2009/0107050 A1 * 4/2009 Suzuki ..... E05F 15/603 49/360
2009/0243826 A1 * 10/2009 Touge ..... B60Q 9/00 340/436
2010/0228447 A1 * 9/2010 Serban ..... B60J 7/0573 701/49
2011/0128018 A1 * 6/2011 Reime ..... F16P 3/12 324/679
2011/0295469 A1 * 12/2011 Rafii ..... E05F 15/43 701/49
2012/0285087 A1 * 11/2012 Eggeling ..... E05B 81/14 49/29
2013/0127479 A1 * 5/2013 Grills ..... G01B 7/14 324/684
2013/0139440 A1 * 6/2013 Wechs ..... E05F 15/0026 49/26
2013/0311039 A1 * 11/2013 Washeleski ..... E05F 15/46 701/36
2014/0182980 A1 * 7/2014 Muramatsu ..... B60T 13/741 188/156
2014/0373454 A1 * 12/2014 Sasaki ..... E05F 15/63 49/350
2015/0096233 A1 * 4/2015 Kojima ..... H02P 3/14 49/31
2016/0052376 A1 * 2/2016 Rosales ..... E05F 15/70 49/31
2016/0288778 A1 10/2016 Muramatsu et al.
2017/0059002 A1 * 3/2017 Sasaki ..... B60J 5/10
2017/0342761 A1 * 11/2017 Conner ..... E05F 15/71

FOREIGN PATENT DOCUMENTS

CN 1928307 A 3/2007
CN 103732460 A 4/2014
EP 1407910 A2 4/2004
JP H05-104950 A 4/1993
JP H10-18713 A 1/1998
JP 2002349135 A 12/2002
JP 2004332263 A 11/2004
JP 2005256529 A 9/2005
JP 4215714 B2 1/2009
JP 2011184966 A 9/2011
JP 2014-159712 A 9/2014

OTHER PUBLICATIONS

Office Action dated Oct. 23, 2018, issued in Japanese Application No. 2015-158416, including English translation.
Japanese Office Action issued in corresponding Japanese Patent Application No. 2015-158416, dated Feb. 5, 2019, with English Translation.

* cited by examiner

DOOR OPENING AND CLOSING DEVICE

CROSS-REFERENCE TO RELATED APPLICATION(S)

The present application claims priority to and incorporates by reference the entire contents of Japanese Patent Application No. 2015-158416 filed in Japan on Aug. 10, 2015.

BACKGROUND OF THE INVENTION

1. Field of the Invention

The disclosure relates to a door opening and closing device.

2. Description of the Related Art

There have conventionally been door opening and closing devices that cause doors to be opened and closed. As such a door opening and closing device, in Japanese Patent No. 4215714, a technique has been disclosed, which is for correcting an acceleration end position in a case where movement of a door is started from a mid-opening/closing position, in a door opening and closing device, by which a moving velocity of the door is increased at a certain preset acceleration while the door is being moved to be opened or closed.

While a door is being moved in an opening direction or a closing direction, a stop operation for stopping the door may be performed by a user. If the door to be opened or closed is a back door, and the back door is attempted to be suddenly stopped in the middle of the movement, the door may rattle. When the back door rattles, motion of the back door may look unstable to the user and the user may feel discomfort.

SUMMARY OF THE INVENTION

It is an object of the present invention to at least partially solve the problems in the conventional technology.

In some embodiments, a door opening and closing device includes: a motor configured to output driving force that causes a back door of a vehicle to be opened or closed; and a controller configured to control the motor. The controller executes automatic opening and closing control for automatically opening or closing the back door by the motor. If the controller detects a stop command causing the back door to be stopped when the automatic opening and closing control is being executed, the controller decreases target velocity of the back door at a predetermined deceleration until the back door stops.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a door opening and closing device according to an embodiment of the present invention will be described in detail, with reference to the drawings. The present invention is not limited by this embodiment. Further, components in the embodiment described below include those easily expected from the disclosure by any person skilled in the art or those substantially equivalent thereto.

Figure 1:
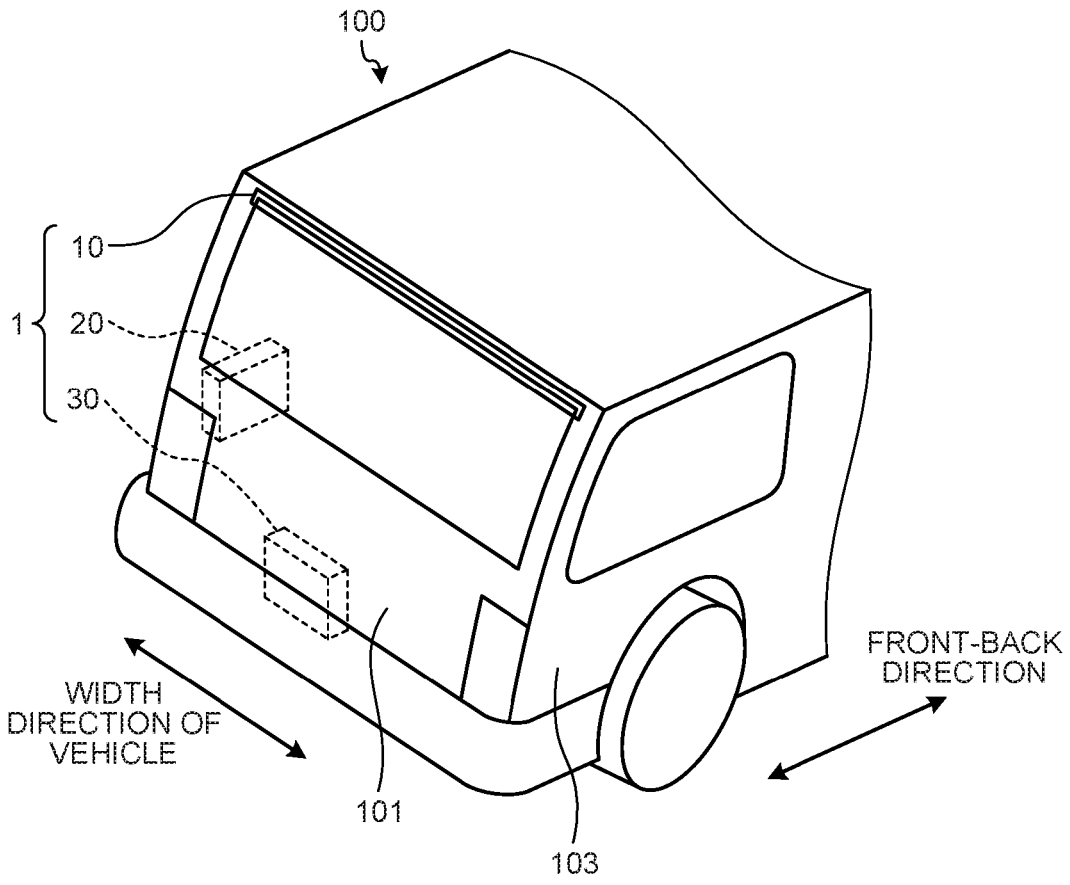
FIG. 1 is a perspective view of a vehicle according to an embodiment.

An embodiment will be described, with reference to FIG. 1 to FIG. 17. This embodiment relates to a door opening and closing device. FIG. 1 is a perspective view of a vehicle according to the embodiment of the present invention, FIGS. 2A and 2B are diagrams illustrating an example of installation of the door opening and closing device according to the embodiment, and FIGS. 3A and 3B are diagrams illustrating a fully open state of a back door.

A door opening and closing device 1 illustrated in FIG. 1 is an opening and closing device that opens and closes a back door 101 of a vehicle 100. The door opening and closing device 1 of this embodiment includes a drive unit 10, an ECU 20, and a lock mechanism 30. The back door 101 is a door that closes or opens a back end opening of a vehicle main body 103. The back door 101 is an upper hinged door, and is freely pivotable about a horizontal axis in a vehicle width direction. The lock mechanism 30 has an interlocking mechanism that restricts opening of the back door 101 by maintaining a fully closed state of the back door 101. As described later, the lock mechanism 30 has an actuator that executes a switch operation to a fully latched state from a half latched state, and a switch operation to an unlatched state from the fully latched state.

The ECU 20 has a function as a controller that controls the drive unit 10 and the lock mechanism 30. The ECU 20 of this embodiment is an electronic control unit. The ECU 20 has a calculation unit, a storage unit, an input and output unit, and the like.

Figure 2A:
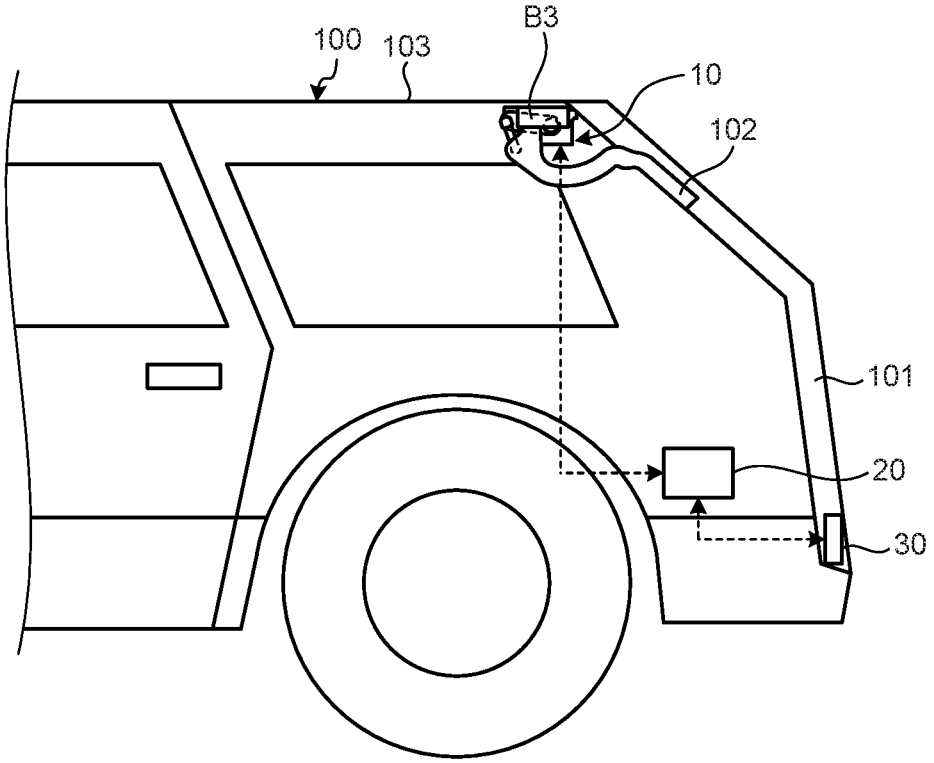
FIGS. 2A and 2B are diagrams illustrating an example of installation of a door opening and closing device according to the embodiment.
Figure 2B:
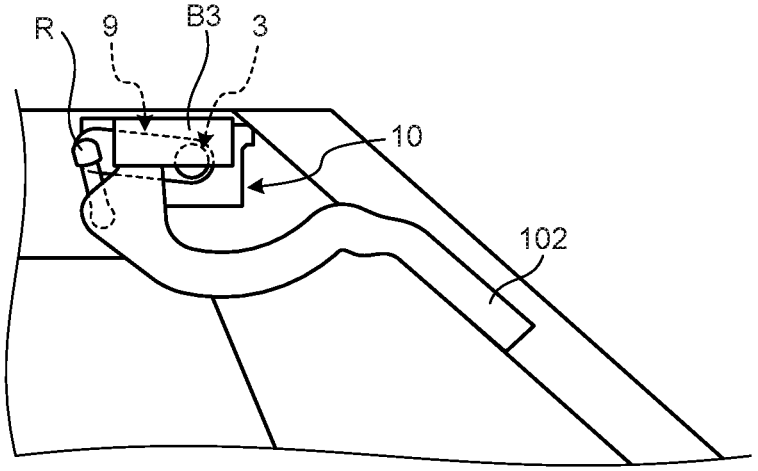
Figure 3A:
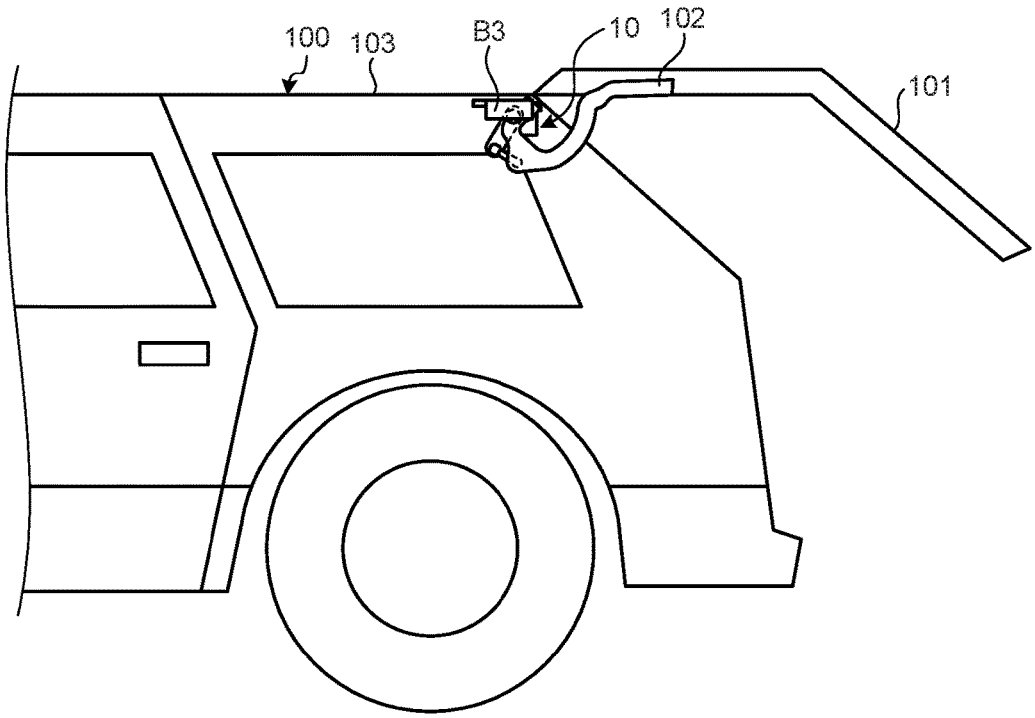
FIGS. 3A and 3B are diagrams illustrating a fully open state of a back door.
Figure 3B:
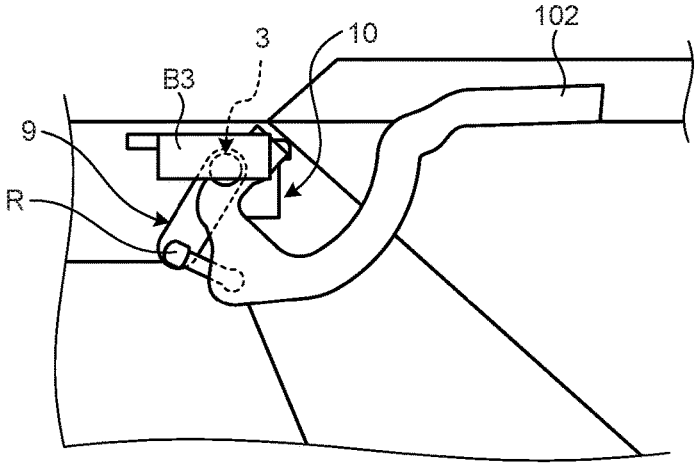

As illustrated in FIG. 2A to FIG. 3B, the drive unit 10 is arranged at an upper portion inside the vehicle 100. In FIG. 2A to FIG. 3B, FIGS. 2A and 3A are diagrams of the whole back portion of the vehicle, and FIGS. 2B and 3B are partial enlarged views of the back portion of the vehicle. The back door 101 is freely pivotably supported by a hinge 102 and a bracket B3. One end of the hinge 102 is connected to the back door 101. The other end of the hinge 102 is supported by a bracket B3 to be freely pivotable about an axis in a width direction of the vehicle 100. FIGS. 2A and 2B illustrate the fully closed state where the back door 101 is in a position to close the back end opening of the vehicle main body 103 (hereinafter, referred to as "fully closed position"). FIGS. 3A and 3B illustrate the fully open state where the back door 101 is in a position at the most open side in a movable range thereof (hereinafter, referred to as "fully open position"). The drive unit 10 is able to move the back door 101 to an arbitrary position between the fully closed position and the fully open position. As illustrated in FIGS. 2A and 2B, the ECU 20 is electrically connected to the drive unit 10 and the lock mechanism 30, to be communicatable therewith.

Figure 4:
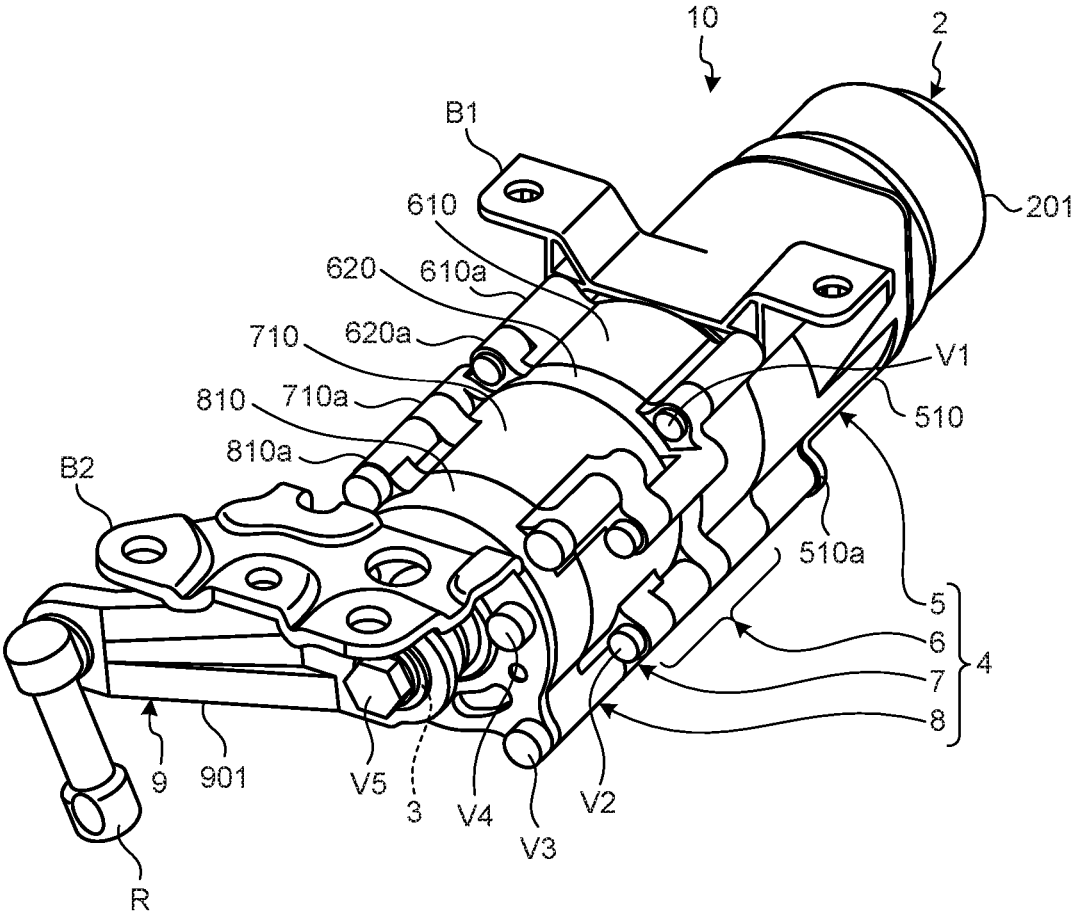
FIG. 4 is a perspective view of a drive unit of the door opening and closing device according to the embodiment.
Figure 5:
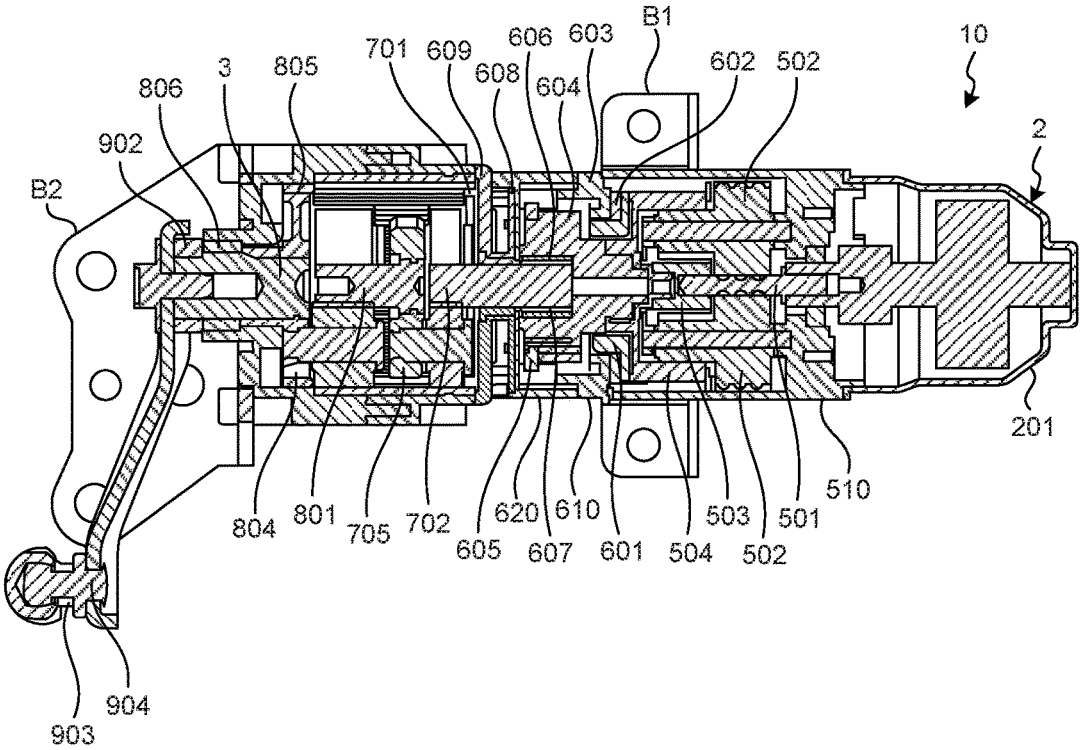
FIG. 5 is a cross sectional view of the drive unit according to the embodiment.

As illustrated in FIG. 4, the drive unit 10 has a motor 2, an output shaft 3, a deceleration mechanism 4, and an arm 9. To the motor 2 and a sensor mechanism 6, electric power is supplied from an on-vehicle power source. As illustrated in FIG. 2A to FIG. 3B, the drive unit 10 is attached to a ceiling of the vehicle 100 in a state where a shaft center of the output shaft 3 extends horizontally in the width direction of the vehicle 100. The arm 9 is connected to the output shaft 3 and rotates integrally with the output shaft 3. One end of a rod R is connected to the arm 9. The other end of the rod R is connected to the hinge 102. As illustrated in FIG. 2A to FIG. 3B, the rod R connects the output shaft 3 and the hinge 102 to each other, and pivots the hinge 102 and the back door 101 in conjunction with rotation of the output shaft 3.

With reference to FIG. 4 to FIG. 8, a specific configuration of the drive unit 10 will be described in detail. The motor 2 generates driving force for opening or closing the back door 101. The motor 2 has a motor case 201, which serves as an accommodating portion, and is tubular. A rotor, an electromagnet, and the like are accommodated in the motor case 201. The motor 2 generates torque in a rotary shaft by the electric power supplied from the on-vehicle power source. The rotary shaft of the motor 2 is connected to the output shaft 3 via the deceleration mechanism 4. The deceleration mechanism 4 decelerates rotation of the motor 2 and transmits the decelerated rotation to the output shaft 3. The arm 9 is fixed to the output shaft 3 by a bolt V5, and pivots about a central shaft line of the output shaft 3.

Figure 6:
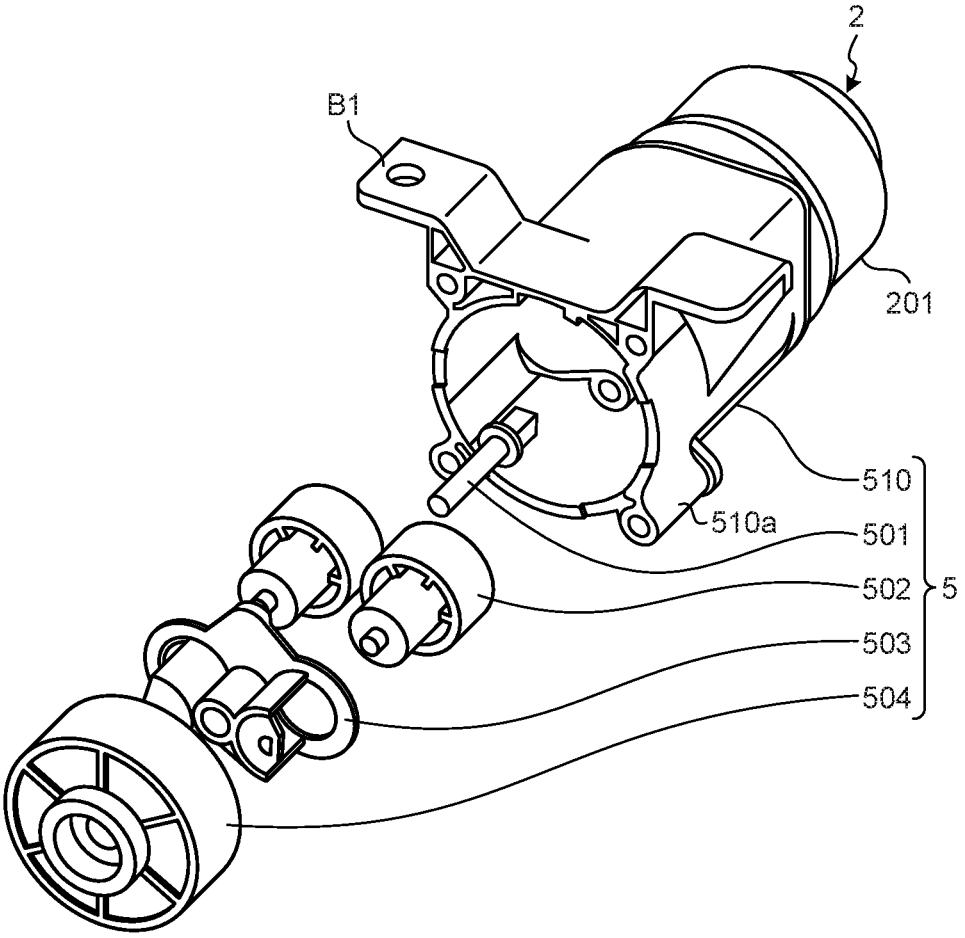
FIG. 6 is an exploded perspective view of a first planetary gear mechanism according to the embodiment.

The deceleration mechanism 4 has a first planetary gear mechanism 5, the sensor mechanism 6, a second planetary gear mechanism 7, and a third planetary gear mechanism 8. The first planetary gear mechanism 5 decelerates the rotation input from the motor 2 and outputs the decelerated rotation. As illustrated in FIG. 6, the first planetary gear mechanism 5 has a first sun gear 501, a first planetary gear 502, a first planetary carrier 503, and a first ring gear 504. The first planetary gear mechanism 5 is unitized by being accommodated in a gear case 510, which is tubular. The first planetary carrier 503 is fitted and unrotatably fixed in the gear case 510. A fixing lug portion 510*a* provided on an outer peripheral surface of the gear case 510 is fixed to the motor case 201 by a screw not illustrated. The gear case 510 has a bracket B1 for fixing the gear case 510 to the vehicle main body 103. The first ring gear 504 is connected to a magnet shaft 604 of the sensor mechanism 6.

The first sun gear 501 is connected to the rotary shaft of the motor 2, and rotates integrally with the rotary shaft of the motor 2. When the first sun gear 501 rotates, the first planetary gear 502 rotates. Because the first planetary carrier 503 is unrotatable, the first planetary gear 502 rotates on its own axis at a fixed position. Therefore, rotation input to the first sun gear 501 is decelerated and output from the first ring gear 504 to the magnet shaft 604.

Figure 7:
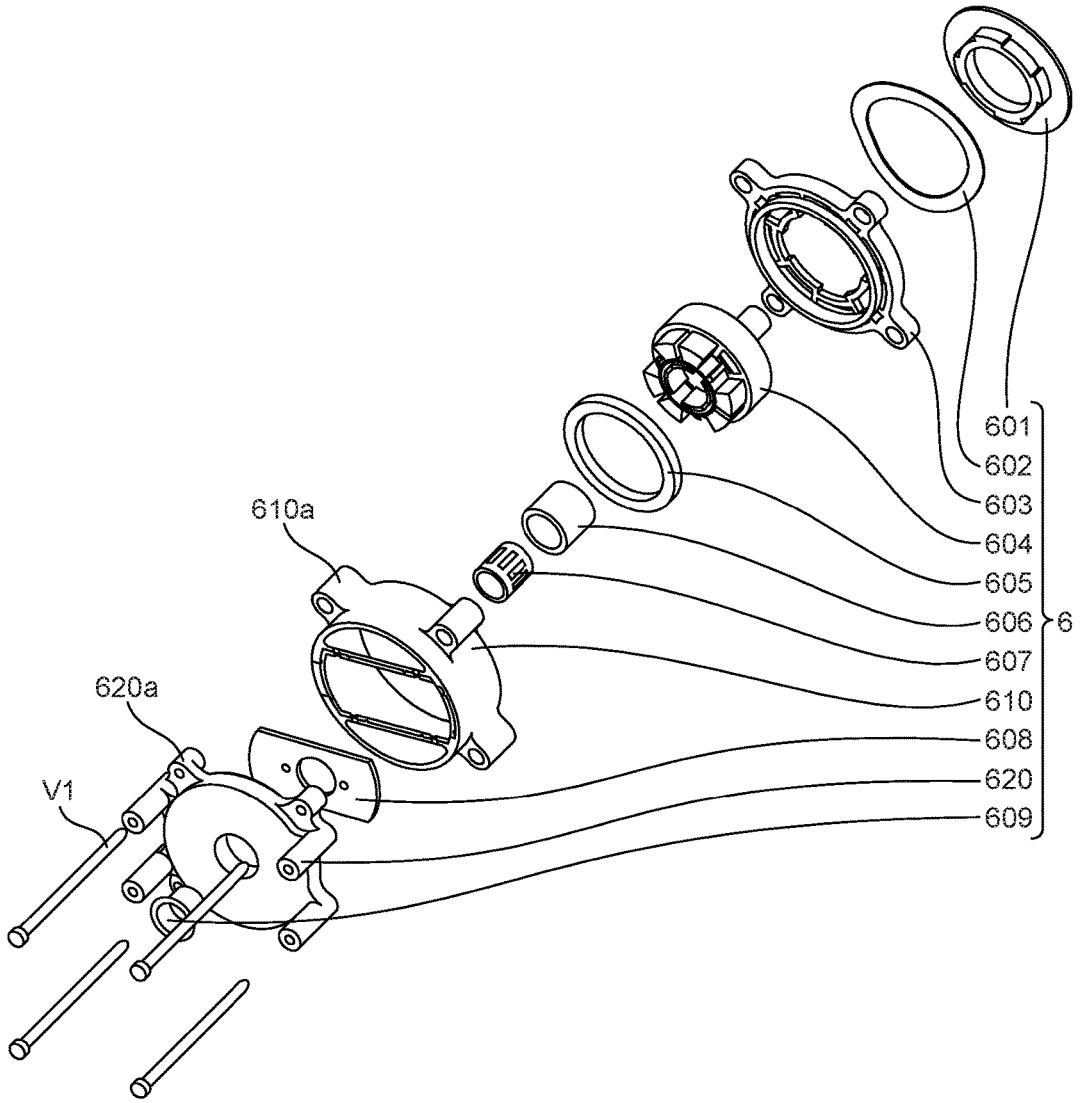
FIG. 7 is an exploded perspective view of a sensor mechanism according to the embodiment.

The sensor mechanism 6 detects operation statuses of the drive unit 10. As illustrated in FIG. 7, the sensor mechanism 6 has a brake bush 601, a wave washer 602, a brake cover 603, the magnet shaft 604, a magnet ring 605, a collar 606, a tolerance ring 607, a giant magneto resistance effect (GMR) sensor 608, and a bush 609. The sensor mechanism 6 is unitized by the respective components being accommodated in sensor cases 610 and 620. Fixing lug portions 610*a* and 620*a* provided on outer peripheral surfaces of the sensor cases 610 and 620 are screwed to the motor case 201 by a bolt V1.

The brake bush 601 is installed in the brake cover 603 via the wave washer 602. The magnet ring 605 is fitted to the magnet shaft 604, and rotates integrally with the magnet shaft 604. The magnet ring 605 is a flat plate and ring-shaped member. S poles and N poles are alternately provided along a circumferential direction of the magnet ring 605. The GMR sensor 608 is fixed to the sensor case 620. The collar 606 is inserted into a concave portion in the magnet shaft 604, the concave portion formed on an output shaft 3 side. Inside the collar 606, the tolerance ring 607 having wave shaped concavity and convexity is inserted. A second sun gear 702 (see FIG. 8) forming the second planetary gear mechanism 7 is inserted inside the tolerance ring 607, and the tolerance ring 607 is interposed between the second sun gear 702 and the magnet shaft 604. The second sun gear 702 is connected to the magnet shaft 604 via the tolerance ring 607, and rotates integrally with the magnet shaft 604. The bush 609 fills in a gap between the sensor case 620 and the second sun gear 702.

When the magnet ring 605 rotates, the GMR sensor 608 detects a change in magnetic flux density from the magnet ring 605, and generates a pulse signal. Based on this pulse signal, a rotational direction and a rotational velocity of the magnet ring 605 are detected. Further, based on the rotational velocity of the magnet ring 605 and a gear ratio of the first planetary gear mechanism 5, a rotational velocity of the motor 2 is calculated.

As described with reference to FIG. 8, the second planetary gear mechanism 7 and the third planetary gear mechanism 8 decelerate rotation input to the second sun gear 702 and output the decelerated rotation. The second planetary gear mechanism 7 and the third planetary gear mechanism 8 are arranged coaxially with the output shaft 3. The second planetary gear mechanism 7 has a ring gear cover 701, the second sun gear 702, a second planetary gear 703, a pin 704, and a second planetary carrier 705. The third planetary gear mechanism 8 has a third sun gear 801, a third planetary gear 802, a pin 803, a third planetary carrier 804, a spacer 805, and a bush 806. The components of the second planetary gear mechanism 7 and the components of the third planetary gear mechanism 8 are unitized by being accommodated in tubular accommodating portions formed of gear cases 710 and 810. On an internal peripheral surface of the gear case 710, a second ring gear 710*b* is formed. The second ring gear 710*b* meshes with each of the second planetary gear 703 and the third planetary gear 802. That is, the second planetary gear mechanism 7 and the third planetary gear mechanism 8 share the second ring gear 710*b* and forms a compound planetary.

The ring gear cover 701 is fitted to the gear case 710. The second sun gear 702 is, as described above, fastened to the magnet shaft 604. That is, the second planetary gear mechanism 7 is connected to the first planetary gear mechanism 5 via the sensor mechanism 6. The second planetary gear 703 is freely rotatably supported by the second planetary carrier 705 via the pin 704. The third sun gear 801 is joined to the second planetary carrier 705. The third planetary gear 802 is freely rotatably supported by the third planetary carrier 804 via the pin 803. The third planetary carrier 804 is connected to the output shaft 3. The spacer 805 fills in a gap between the gear case 710 and the gear case 810. The bush 806 fills in a gap between the gear case 810 and the output shaft 3.

A fixing lug portion 710*a* provided on an outer peripheral surface of the gear case 710 is fixed to the sensor case 620 by a bolt V2. A fixing lug portion 810*a* provided on an outer peripheral surface of the gear case 810 is fixed to the gear case 710 by a bolt V3. A bracket B2 is fixed to the gear case 810 by a bolt V4. The bracket B2 is fixed to the vehicle main body 103 by a bolt.

Since the second ring gear 710*b* is unrotatable, when the second sun gear 702 rotates, the second planetary gear 703 rotates on its own axis, and the second planetary carrier 705 rotates about the central shaft line of the output shaft 3. The third sun gear 801 rotates, together with the second planetary carrier 705. When the third sun gear 801 rotates, the third planetary gear 802 rotates on its own axis and the third planetary carrier 804 rotates about the central shaft line of the output shaft 3. Therefore, rotation input from the magnet shaft 604 of the sensor mechanism 6 to the second sun gear 702 is decelerated via to the second planetary gear 703, the second planetary carrier 705, the third sun gear 801, the third planetary gear 802, and the third planetary carrier 804, and transmitted to the output shaft 3.

The arm 9 has an arm member 901, an arm spacer 902, a cushion 903, and a shaft rod 904. A proximal end portion of the arm 9 is connected to the output shaft 3. A distal end portion of the arm 9 is connected, as illustrated in FIG. 2A to FIG. 3B, to the back door 101 via the rod R and the hinge 102. The arm 9 transmits motive power, which has been transmitted to the output shaft 3 from the motor 2, to the hinge 102 via the rod R.

Figure 8:
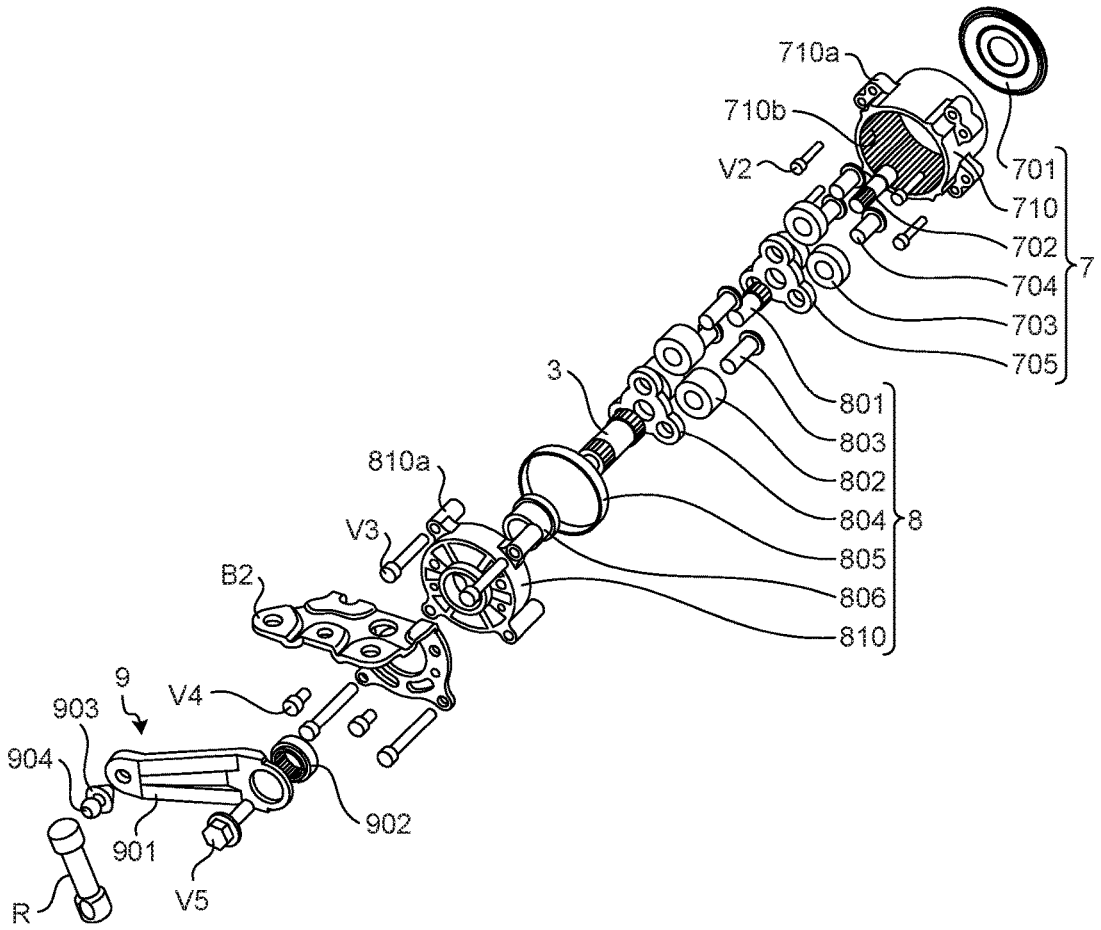
FIG. 8 is an exploded perspective view of a second planetary gear mechanism, a third planetary gear mechanism, and an arm, according to the embodiment.

As illustrated in FIG. 8, the arm spacer 902 is fixed to a proximal end portion of the arm member 901. The arm spacer 902 is a ring shaped member, and is fixed to the arm member 901 by welding. The shaft rod 904 is connected to a distal end portion of the arm member 901 via the cushion 903. The rod R is connected to the shaft rod 904 by a clip not illustrated.

Figure 9:
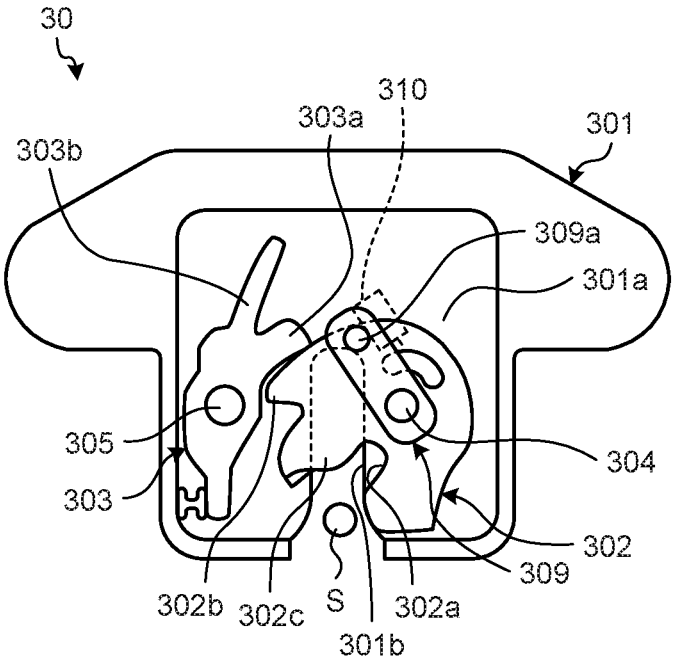
FIG. 9 is a plan view of main parts illustrating an unlatched state of a lock mechanism according to the embodiment.
Figure 10:
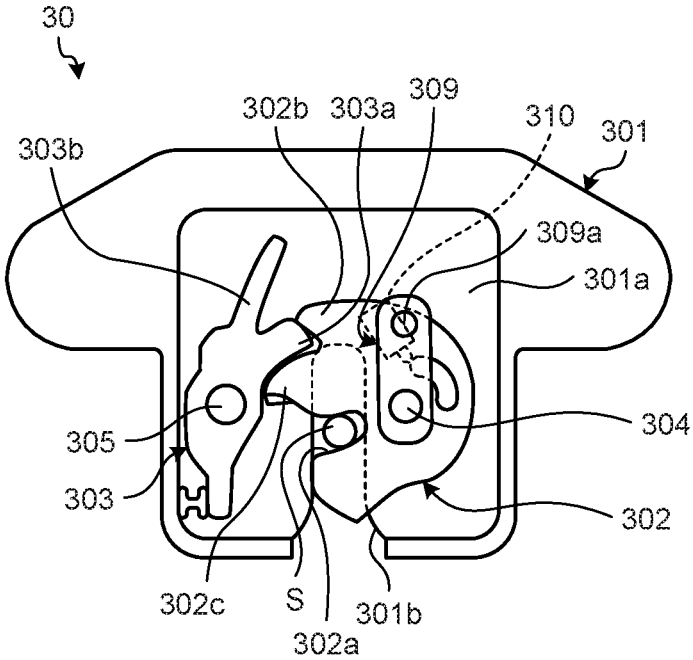
FIG. 10 is a plan view of main parts illustrating a half latched state of the lock mechanism according to the embodiment.
Figure 11:
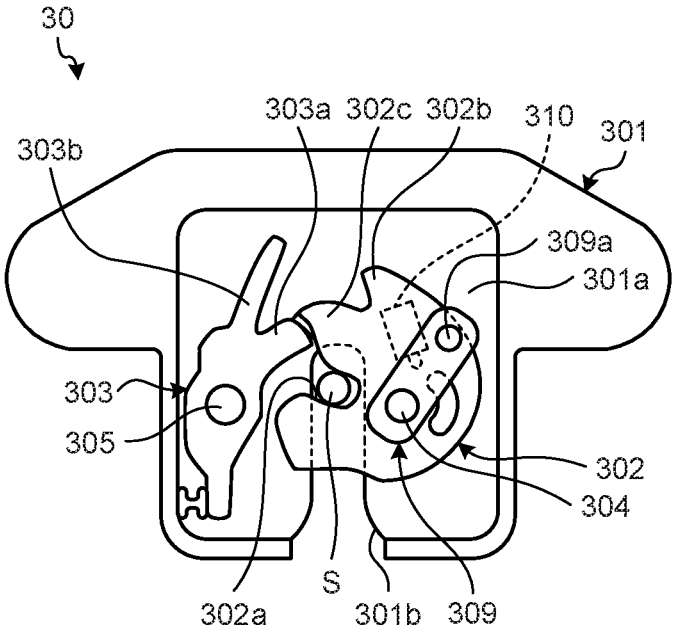
FIG. 11 is a plan view of main parts illustrating a fully latched state of the lock mechanism according to the embodiment.

With reference to FIG. 9 to FIG. 12, the lock mechanism 30 will now be described. The lock mechanism 30 is arranged in the back door 101. The lock mechanism 30 locks the back door 101 by engaging with the striker S arranged in the vehicle main body 103. As illustrated in FIG. 9 to FIG. 11, the lock mechanism 30 has a cover plate 301, a latch 302, and a ratchet 303. The latch 302 and the ratchet 303 are arranged in an accommodating portion 301*a*, which is provided in the cover plate 301 and is concave shaped. The cover plate 301 has an advancing groove 301*b*, through which the striker S advances. The latch 302 is freely rotatably supported by a latch shaft 304. The latch 302 is biased in an anticlockwise direction (opening direction) in FIG. 9 to FIG. 11 by a spring. The ratchet 303 is freely rotatably supported by a ratchet shaft 305. The ratchet 303 is biased in a clockwise direction in FIG. 9 to FIG. 11 by a spring.

The lock mechanism 30 is switched over among the unlatched state illustrated in FIG. 9, the half latched state illustrated in FIG. 10, and the fully latched state illustrated in FIG. 11. The unlatched state is, as illustrated in FIG. 9, a state where an engagement groove 302*a* of the latch 302 is not engaged with the striker S. When the back door 101 moves in the closing direction from the unlatched state, the striker S advances into the advancing groove 301*b*, abuts against a striker abutment portion 302*c* of the latch 302, and rotates the latch 302 in an engaging direction. In FIG. 9 to FIG. 11, the clockwise rotational direction of the latch 302 is the engaging direction. When the latch 302 rotates in the engaging direction, as illustrated in FIG. 10, the half latched state is reached, where the engagement groove 302*a* of the latch 302 engages with the striker S and a claw portion 302*b* thereof interlocks with a latch interlocking portion 303*a* of the ratchet 303. In the half latched state, rotation of the latch 302 in the opening direction (anticlockwise direction) is restricted by the latch interlocking portion 303*a*.

When the latch 302 rotates further in the engaging direction from the half latched state, as illustrated in FIG. 11, the fully latched state is reached, where the latch interlocking portion 303*a* of the ratchet 303 abuts against the striker abutment portion 302*c* of the latch 302. When the lock mechanism 30 is brought into the fully latched state, the back door 101 is brought into the fully closed state.

The lock mechanism 30 has a driving mechanism 306 (see FIG. 12), which performs switch over from the half latched state to the fully latched state, and switch over from the fully latched state to the unlatched state. The driving mechanism 306 includes a motor 307 and a sector gear 308. The sector gear 308 is freely rotatably supported and is rotationally driven by motive power of the motor 307. The sector gear 308 presses, according to a direction in which the sector gear 308 rotates, an abutment portion 309*a* of a latch lever 309 (see FIG. 9) or a release operating portion 303*b* of the ratchet 303 (see FIG. 9). The latch lever 309 is fixed to the latch 302, and rotates, together with the latch 302, about the latch shaft 304. The abutment portion 309*a* is a cylindrically shaped pin, and protrudes in a direction of the latch shaft 304. Therefore, when the abutment portion 309*a* is pressed by the sector gear 308, the latch 302 rotates about the latch shaft 304. The release operating portion 303*b* is a protruding portion that protrudes outward in a radial direction of the ratchet shaft 305 in the ratchet 303. The sector gear 308 presses the release operating portion 303*b* via a transmission mechanism not illustrated.

If the motor 307 rotates in a closing direction when the lock mechanism 30 is in the half latched state, the sector gear 308 abuts against the abutment portion 309*a* of the latch lever 309 and rotates the latch 302 in the engaging direction. Thereby, the lock mechanism 30 is switched over to the fully latched state. On the contrary, if the motor 307 rotates in an opening direction when the lock mechanism 30 is in the fully latched state, the sector gear 308 presses the release operating portion 303*b* of the ratchet 303 via the transmission mechanism, and rotates the ratchet 303 in the anticlockwise direction. Thereby, the engagement between the latch interlocking portion 303*a* of the ratchet 303 and the latch 302 is released, and the lock mechanism 30 is switched over to the unlatched state.

Figure 12:
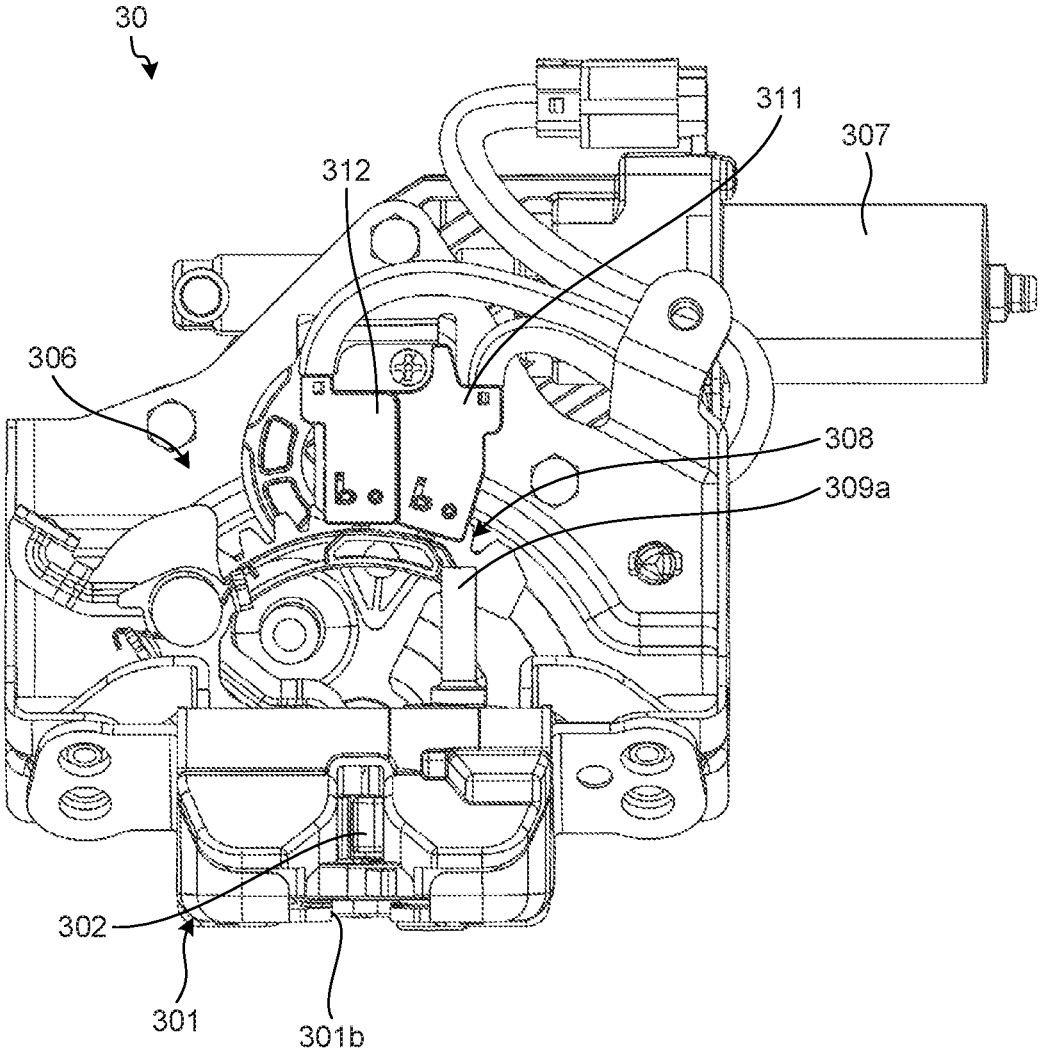
FIG. 12 is a front view illustrating the lock mechanism according to the embodiment.

As illustrated in FIG. 9 to FIG. 11, the lock mechanism 30 has a half switch 310. The half switch 310 is a switch that detects that the latch 302 is in a half latched position. As illustrated in FIG. 12, the lock mechanism 30 has a closing switch 311 and an opening switch 312. The closing switch 311 and the opening switch 312 detect rotational positions of the sector gear 308. Based on output signals of the closing switch 311 and the opening switch 312, the latch 302 being in an unlatched position or a fully latched position, and the sector gear 308 being in a neutral position, are detected.

Next, automatic opening and closing control executed by the drive unit 10 will now be described. The automatic opening and closing control is control that causes the motor 2 of the drive unit 10 to automatically open or close the back door 101. The automatic opening and closing control is executed by the ECU 20. The automatic opening and closing control includes automatic opening control for automatically opening the back door 101 and automatic closing control for automatically closing the back door 101. When the ECU 20 detects an automatic opening command, the ECU 20 executes the automatic opening control. The automatic opening command is generated, when an operation requesting the back door 101 to be automatically opened has been input by a user and an automatic opening condition has been satisfied. The automatic opening condition is a condition under which the automatic opening control is permitted, and includes, for example, a condition where the vehicle 100 is being stopped.

The automatic opening control is control for opening the back door 101 to a predetermined target openness to be stopped. The automatic opening control is control for opening the back door 101 that has stopped at the fully closed position or a position of an intermediate openness. When the ECU 20 detects an automatic opening command, the ECU 20 switches over the lock mechanism 30 to the unlatched state, if the lock mechanism 30 is in the fully latched state or half latched state. If the ECU 20 detects the unlatched state of the lock mechanism 30, the ECU 20 causes the motor 2 to rotate in the opening direction to pivot the back door 101 towards the fully open position. Based on a pulse signal output from the sensor mechanism 6, the ECU 20 calculates a moving direction and a moving velocity of the back door 101, and the current openness of the back door 101. An openness of the back door 101 is calculated with reference to an openness at the fully closed position, for example. The ECU 20 causes the motor 2 to pivot the back door 101 until the calculated openness becomes the target openness to be stopped. The target openness to be stopped is typically an openness at the fully open position of the back door 101, but instead, may be an openness specified by a user.

Figure 13:
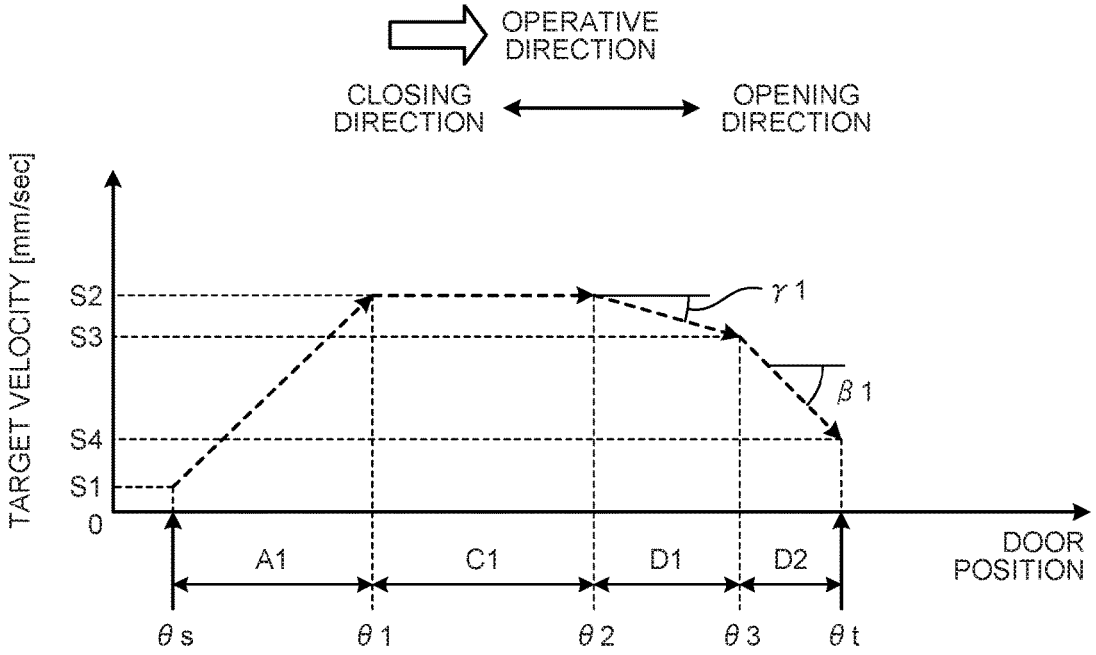
FIG. 13 is a target velocity map according to automatic opening control of the embodiment.

The ECU 20 of this embodiment controls the rotational velocity of the motor 2 in the automatic opening control, based on a target velocity map illustrated in FIG. 13. In FIG. 13, the horizontal axis represents position (openness) of the back door 101, and the vertical axis represents target moving velocity of the back door 101. The moving velocity of the back door 101 is, for example, moving velocity of a lower end portion (outermost peripheral portion) of the back door 101. As to the moving velocity in FIG. 13, velocity towards the opening direction of the back door 101 is assumed to be positive. The actual moving velocity of the back door 101 is calculated based on the rotational velocity of the motor 2, a gear ratio of the deceleration mechanism 4, and specifications of the back door 101. Based on a pulse signal output from the sensor mechanism 6, the ECU 20 calculates the current moving velocity of the back door 101. The ECU 20 controls the value of electric current flowing to the motor 2 so as to match the rotational velocity of the motor 2 with a target velocity.

In FIG. 13, an activation start position θs is a door position where the automatic opening control is started, and is, for example, the fully closed position of the back door 101. A target openness to be stopped θt is a target position where the back door 101 is to be finally stopped in the automatic opening control. As illustrated in FIG. 13, along the door position, an acceleration region A1, a constant velocity region C1, a first deceleration region D1, and a second deceleration region D2 are provided. The acceleration region A1 is a region where the moving velocity of the back door 101 is accelerated at the start of the automatic opening control. The acceleration region A1 is a range of the door position from the activation start position θs to an acceleration end position θ1. The target velocity of the back door 101 at the activation start position θs is a first velocity S1. In the acceleration region A1, as the position of the back door 101 changes in the opening direction, the target velocity linearly increases. The target velocity at the acceleration end position θ1 is a second velocity S2.

The constant velocity region C1 is a region where the target velocity of the back door 101 is of a constant value. The constant velocity region C1 is a region continuous with the acceleration region A1, and is a range of the door position from the acceleration end position θ1 to a deceleration start position θ2. The target velocity of the back door 101 in the constant velocity region C1 is the second velocity S2.

The first deceleration region D1 and the second deceleration region D2 are regions where the moving velocity of the back door 101 is decelerated. The first deceleration region D1 is a region continuous with the constant velocity region C1, and is a range of the door position from the deceleration start position θ2 to a deceleration intermediate position θ3. In the first deceleration region D1, as the position of the back door 101 changes in the opening direction, the target velocity linearly decreases from the second velocity S2 to a third velocity S3. The second deceleration region D2 is a region continuous with the first deceleration region D1, and is a range of the door position from the deceleration intermediate position θ3 to the target openness to be stopped θt. The second deceleration region D2 is a final deceleration region where the ECU 20 causes the back door 101 to move to the target openness to be stopped θt while decelerating the velocity of the back door 101. In the second deceleration region D2, as the position of the back door 101 changes in the opening direction, the target velocity linearly decreases from the third velocity S3 to a fourth velocity S4. The target velocity of the back door 101 when the position (openness) of the back door 101 reaches the target openness to be stopped θt is the fourth velocity S4. The fourth velocity S4 is faster than the first velocity S1. Further, the deceleration in the second deceleration region D2 is larger than the deceleration in the first deceleration region D1. In other words, a gradient β1 of the target velocity in the second deceleration region D2 is larger than a gradient γ1 of the target velocity in the first deceleration region D1. The gradient of the target velocity is a gradient with respect to the horizontal axis (door position axis), and the gradient when the target velocity does not change is "0".

When the ECU 20 detects an automatic closing command, the ECU 20 executes the automatic closing control. The automatic closing command is generated when an operation requesting the back door 101 to be automatically closed has been input by a user and an automatic closing condition has been satisfied. The automatic closing condition is a condition under which the automatic closing control is permitted, and includes, for example, a condition where the lock mechanism 30 is in the unlatched state. The automatic closing control is control for closing the back door 101 to a predetermined target openness to be stopped. The automatic closing control is control for closing the back door 101 that has stopped at the fully open position or a position of an intermediate openness. In the automatic closing control, the ECU 20 causes the motor 2 to rotate in the closing direction to pivot the back door 101 towards the fully closed position.

Figure 14:
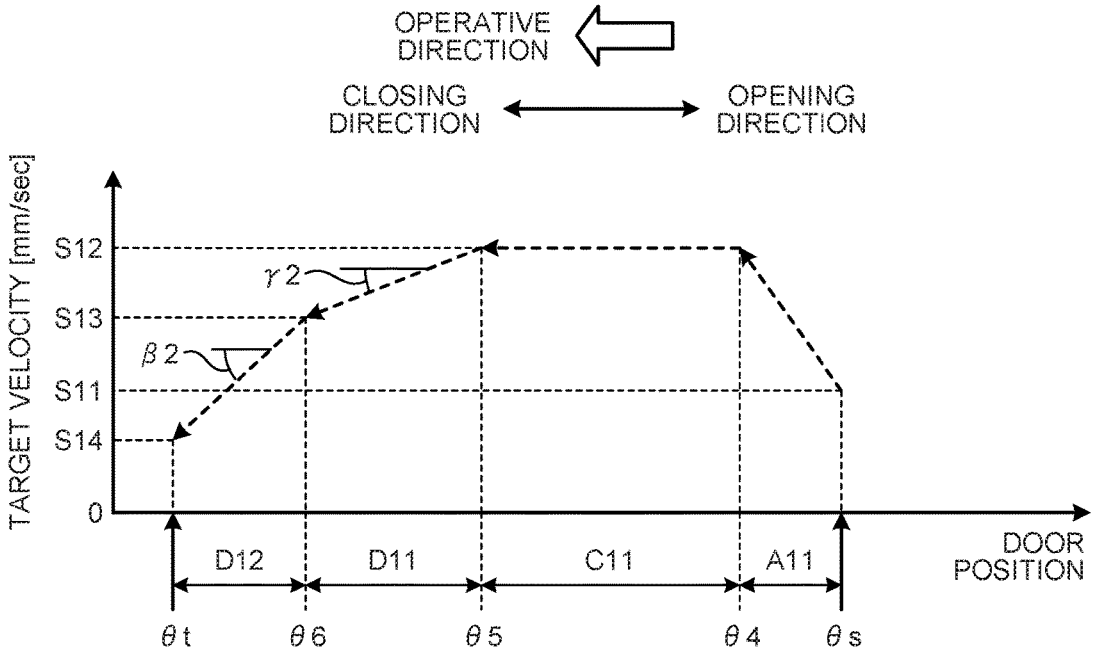
FIG. 14 is a target velocity map according to automatic closing control of the embodiment.

The ECU 20 of this embodiment controls the rotational velocity of the motor 2 in the automatic closing control, based on a target velocity map illustrated in FIG. 14. As to the moving velocity (vertical axis) in FIG. 14, velocity towards the closing direction of the back door 101 is assumed to be positive. The activation start position θs in FIG. 14 is a door position where the automatic closing control is started, and is, for example, the fully open position of the back door 101. The target openness to be stopped θt is a target position where the back door 101 is finally stopped in the automatic closing control. In this embodiment, the target openness to be stopped θt of the automatic closing control is the fully closed position. As illustrated in FIG. 14, along the door position, an acceleration region A11, a constant velocity region C11, a first deceleration region D11, and a second deceleration region D12 are provided. The acceleration region A11 is a region where the moving velocity of the back door 101 is accelerated at the start of the automatic closing control. The acceleration region A11 is a range of the door position from the activation start position θs to an acceleration end position θ4. The target velocity of the back door 101 at the activation start position θs is a first velocity S11. In the acceleration region A11, as the position of the back door 101 changes in the closing direction, the target velocity linearly increases. The target velocity at the acceleration end position θ4 is a second velocity S12.

The constant velocity region C11 is a region where the target velocity of the back door 101 is of a constant value. The constant velocity region C11 is a region continuous with the acceleration region A11, and is a range of the door position from the acceleration end position θ4 to a deceleration start position θ5. The target velocity of the back door 101 in the constant velocity region C11 is the second velocity S12.

The first deceleration region D11 and the second deceleration region D12 are regions where the moving velocity of the back door 101 is decelerated. The first deceleration region D11 is a region continuous with the constant velocity region C11, and is a range of the door position from the deceleration start position θ5 to a deceleration intermediate position θ6. In the first deceleration region D11, as the position of the back door 101 changes in the closing direction, the target velocity linearly decreases from the second velocity S12 to a third velocity S13. The second deceleration region D12 is a region continuous with the first deceleration region D11, and is a range of the door position from the deceleration intermediate position θ6 to the target openness to be stopped θt. The second deceleration region D12 is a final deceleration region where the ECU 20 causes the back door 101 to move to the target openness to be stopped θt while decelerating the velocity of the back door 101. In the second deceleration region D12, as the position of the back door 101 changes in the closing direction, the target velocity linearly decreases from the third velocity S13 to a fourth velocity S14. The target velocity of the back door 101 when the position (openness) of the back door 101 reaches the target openness to be stopped θt is the fourth velocity S14. The fourth velocity S14 is slower than the first velocity S11. Further, the deceleration in the second deceleration region D12 is larger than the deceleration in the first deceleration region D11. In other words, a gradient β2 of the target velocity in the second deceleration region D12 is larger than a gradient γ2 of the target velocity in the first deceleration region D11.

The ECU 20 stops the back door 101, if the ECU 20 detects a stop command for stopping the back door 101 when the automatic opening control or the automatic closing control is being executed. The ECU 20 detects a stop and hold operation performed by a user, as the stop command. When a switch operation is performed on a switch provided on a driver's seat or the back door 101 when the automatic opening control or automatic closing control is being executed, the ECU 20 detects this switch operation as the stop and hold operation. The ECU 20 performs a stop operation for stopping the back door 101 when the stop and hold operation is detected.

When the ECU 20 of this embodiment detects the stop and hold operation when the automatic opening control or automatic closing control is being executed, the ECU 20 decreases the target velocity of the back door 101 at a predetermined deceleration until the back door 101 stops. By decreasing the target velocity of the back door 101 at the predetermined deceleration, the ECU 20 suppresses rattling of the back door 101 in the stop operation.

Figure 15:
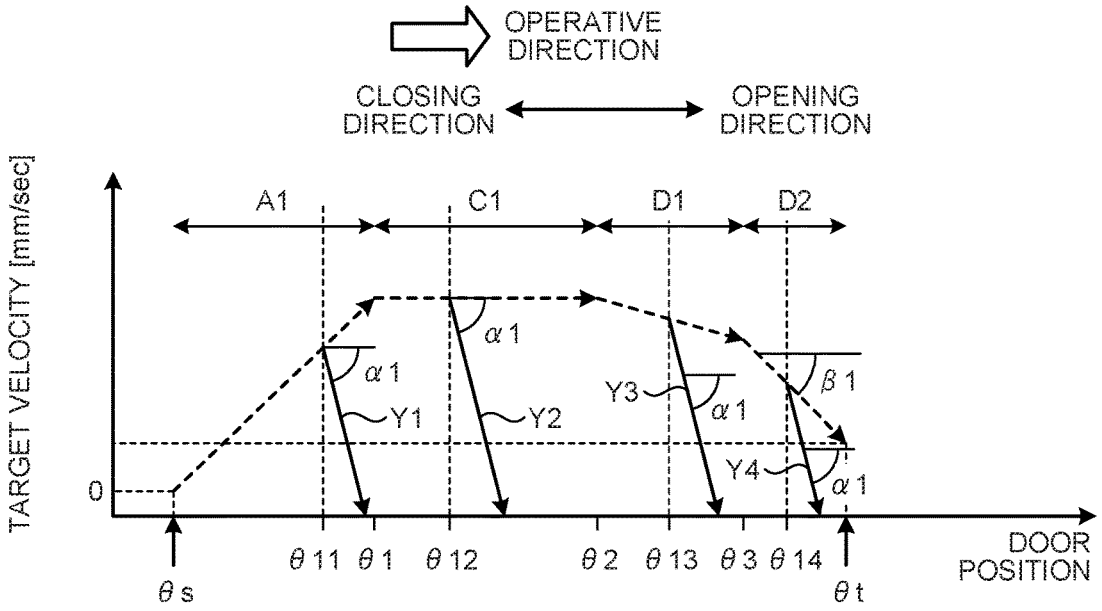
FIG. 15 is a diagram illustrating a stop operation from the automatic opening control of the embodiment.

With reference to FIG. 15, the stop operation from the automatic opening control will now be described. For example, it is assumed that the stop and hold operation has been detected at a door position θ11 in the acceleration region A1. In this case, the ECU 20 decreases the target velocity of the back door 101 at the predetermined deceleration until the back door 101 stops, as illustrated with an arrow Y1. The predetermined deceleration is a deceleration at which a gradient of the target velocity in the stop operation becomes α1. The ECU 20 decreases the target velocity of the back door 101 at a constant deceleration in the stop operation from the automatic opening control. When the stop and hold operations are detected at a door position θ12 in the constant velocity region C1, a door position θ13 in the first deceleration region D1, and a door position θ14 in the second deceleration region D2, the ECU 20 executes the stop operations as illustrated with arrows Y2, Y3, and Y4, respectively. That is, in whichever one of the regions A1, C1, D1, and D2 the stop and hold operation is detected, the ECU 20 of this embodiment decreases the target velocity of the back door 101 at the same deceleration.

Figure 16:
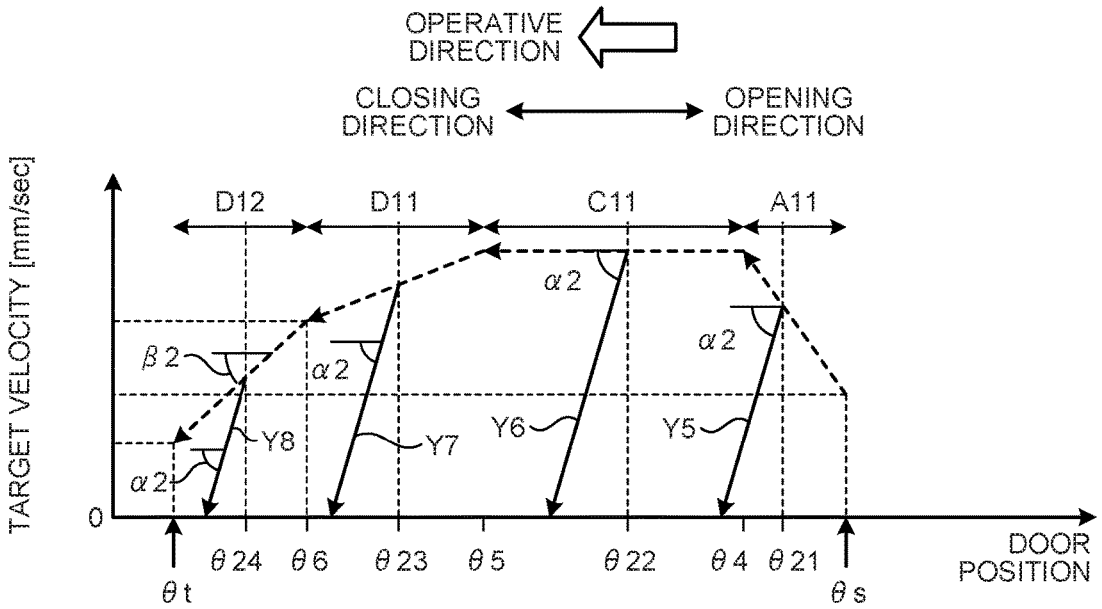
FIG. 16 is a diagram illustrating a stop operation from the automatic closing control of the embodiment.

With reference to FIG. 16, a stop operation from the automatic closing control will now be described. For example, it is assumed that a stop and hold operation has been detected at a door position θ21 in the acceleration region A11. In this case, the ECU 20 decreases the target velocity of the back door 101 at a predetermined deceleration until the back door 101 stops, as illustrated with an arrow Y5. The predetermined deceleration is a deceleration at which a gradient of the target velocity in the stop operation becomes α2. The ECU 20 decreases the target velocity of the back door 101 at a constant deceleration in the stop operation from the automatic closing control. When the stop and hold operations are detected at a door position θ22 in the constant velocity region C11, a door position θ23 in the first deceleration region D11, and a door position θ24 in the second deceleration region D12, the ECU 20 executes the stop operations as illustrated with arrows Y6, Y7, and Y8, respectively. That is, in whichever one of the regions A11, C11, D11, and D12 the stop and hold operation is detected, the ECU 20 of this embodiment decreases the target velocity of the back door 101 at the same deceleration.

Figure 17:
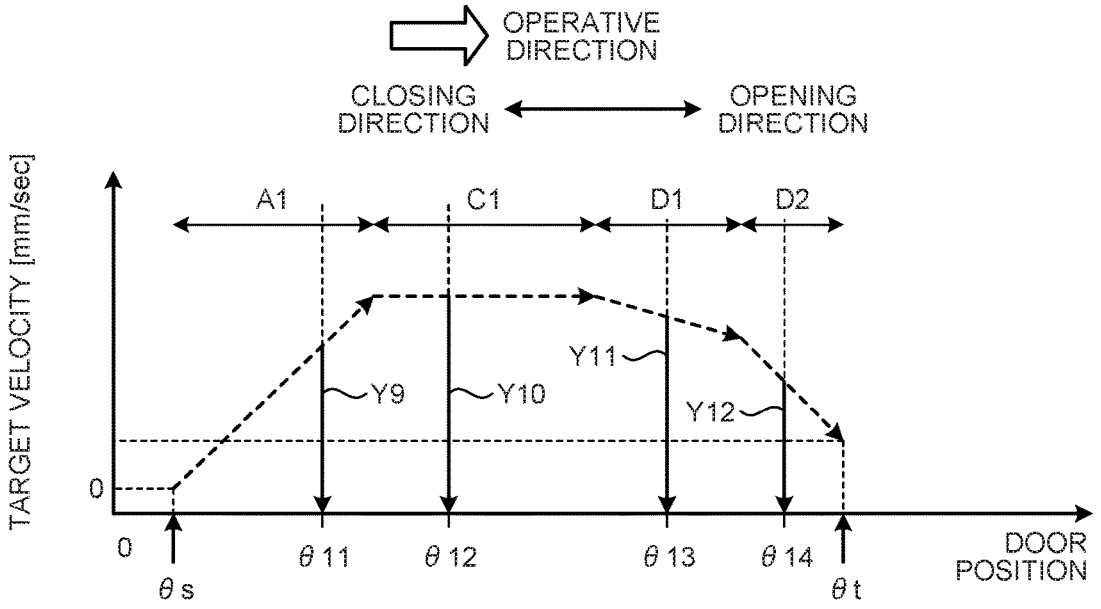
FIG. 17 is a diagram illustrating a stop operation according to a comparative example.

As described above, if the ECU 20 of this embodiment detects a stop command when the automatic opening and closing control (automatic opening control or automatic closing control) is being executed, the ECU 20 decreases the target velocity of the back door 101 at the predetermined deceleration until the back door 101 stops to thereby decrease the actual velocity of the back door 101 at the predetermined deceleration. Thereby, as compared to a comparative example described below, rattling of the back door 101 upon stopping of the back door 101 is suppressed. FIG. 17 illustrates a stop operation according to the comparative example. In the comparative example, when stop and hold operations are detected at the door positions θ11, θ12, θ13, and θ14, the target velocity is changed to "0" as illustrated with arrows Y9 to Y12. Even if the rotation of the back door 101 is attempted to be stopped by immediate nulling of the motor output like this, due to the inertia, the back door 101 is unable to stop suddenly, and stops after rattling thereof occurs. If the rattling of the back door 101 occurs, to the user, the motion of the back door 101 will appear unstable and the user will feel discomfort.

On the contrary, if the stop and hold operation is detected, the ECU 20 of this embodiment decreases the target velocity of the back door 101 at the predetermined deceleration. By such provision of a deceleration period, the motion of the back door 101 is stabilized, and rattling thereof is suppressed. The predetermined deceleration is determined beforehand based on results of compliance experiments, simulation, or the like, so that the back door 101 is able to be stopped quickly while rattling of the back door 101 is suppressed. The predetermined deceleration is preferably determined such that, for example, a time required from the detection of the stop and hold operation until the stoppage of the back door 101, and an amount of movement of the back door 101 become equal to or smaller than predetermined values. Thereby, both improvement in responsiveness to user operations and suppression of rattling are able to be achieved.

Further, the predetermined deceleration according to this embodiment is larger than the deceleration of the back door 101 when the openness of the back door 101 reaches the target openness to be stopped θt in the automatic opening and closing control. As illustrated in FIG. 15, the deceleration of the back door 101 when the openness of the back door 101 reaches the target openness to be stopped θt in the automatic opening control is the deceleration in the second deceleration region D2. This deceleration corresponds to the gradient β1. Further, the predetermined deceleration in the stop operation from the automatic opening control corresponds to the gradient α1. According to this embodiment, the predetermined deceleration is determined such that the gradient α1 becomes larger than the gradient β1. By such determination of the value of the predetermined deceleration, in the stop operation from the automatic opening control, the back door 101 is able to be stopped at a position before the target openness to be stopped θt.

The same applies to the stop operation from the automatic closing control. As illustrated in FIG. 16, in the stop operation from the automatic closing control, the predetermined deceleration (corresponding to the gradient α2) is larger than the deceleration (corresponding to the gradient β2) of the back door 101 when the openness of the back door 101 reaches the target openness to be stopped θt. Therefore, in the stop operation from the automatic closing control, the back door 101 is able to be stopped at a position before the target openness to be stopped θt.

The predetermined deceleration (corresponding to the gradient α1) in the automatic opening control and the predetermined deceleration (corresponding to the gradient α2) in the automatic closing control may be of the same value, or of different values.

First Modification of Embodiment

A first modification of the embodiment will now be described. The predetermined deceleration may be set to different values according to inclinations of the vehicle 100 in a front-back direction. For example, if the vehicle 100 is stopping at a spot on an upward slope, as compared to a case where the vehicle 100 is stopping at a flat spot, a component of gravity acting on the back door 101 in the closing direction is decreased (or a component thereof in the opening direction is increased). Due to an inclination of an upward slope, resistance to the opening operation is decreased in the automatic opening control and resistance to the closing operation is increased in the automatic closing control. Accordingly, from the viewpoint of suppressing rattling of the back door 101 in the stop operation, in the automatic opening control, the predetermined deceleration in a case where the vehicle 100 is stopping at a spot on an upward slope is preferably of a value smaller than the predetermined deceleration for a case where the vehicle 100 is stopping at a flat spot. Further, the predetermined deceleration in a case where the angle of the upward slope is larger may be of a value smaller than the predetermined deceleration for a case where the angle of the upward slope is smaller. In the automatic closing control, the predetermined deceleration in a case where the vehicle 100 is stopping at a spot on an upward slope is preferably of a value larger than the predetermined deceleration for a case where the vehicle 100 is stopping at a flat spot. Furthermore, the predetermined deceleration in a case where the angle of the upward slope is larger may be of a value larger than the predetermined deceleration for a case where the angle of the upward slope is smaller.

On the contrary, if the vehicle 100 is stopping at a spot on a downward slope, due to the inclination of the downward slope, resistance to the opening operation is increased in the automatic opening control, and resistance to the closing operation is decreased in the automatic closing control. Accordingly, in the automatic opening control, the predetermined deceleration in a case where the vehicle 100 is stopping at a spot on a downward slope is preferably of a value larger than the predetermined deceleration for a case where the vehicle 100 is stopping at a flat spot. Further, the predetermined deceleration in a case where the angle of the downward slope is larger may be of a value larger than the predetermined deceleration for a case where the angle of the downward slope is smaller. In the automatic closing control, the predetermined deceleration in a case where the vehicle 100 is stopping at a spot on a downward slope is preferably of a value smaller than the predetermined deceleration for a case where the vehicle 100 is stopping at a flat spot. Furthermore, the predetermined deceleration in a case where the angle of the downward slope is larger may be of a value smaller than the predetermined deceleration for a case where the angle of the downward slope is smaller.

Second Modification of Embodiment

A second modification of the embodiment will now be described. The predetermined deceleration may be set to different values according to environmental temperatures of the vehicle 100. For example, if a damper is interposed between the vehicle main body 103 and the back door 101, according to a temperature characteristic of the damper, the predetermined velocity may be made variable. As an example, it is assumed that damping force of the damper is smaller when the environmental temperature is high, than when the environmental temperature is low. In this case, the predetermined deceleration in a case where the environmental temperature is higher may be of a value smaller than the predetermined deceleration for a case where the environmental temperature is lower. The predetermined deceleration may be decreased as the environmental temperature becomes higher than the normal temperature, or the predetermined deceleration may be increased as the environmental temperature becomes lower.

Third Modification of Embodiment

A third modification of the embodiment will now be described. In the stop operation from the automatic opening control or automatic closing control, the deceleration of the back door 101 may change in the middle of the stop operation. For example, as the stop operation progresses, the deceleration of the back door 101 may be increased. How the deceleration is changed may be stepwise or curvedly. The lower limit of the deceleration when the predetermined deceleration is changed is preferably of a value larger than the deceleration of the back door 101 when the openness of the back door 101 reaches the target openness to be stopped θt.

What has been disclosed in the above embodiment and the respective modifications thereof may be implemented by being combined with one another as appropriate.

A controller of a door opening and closing device according to the disclosure reduces a target velocity of a back door at a predetermined deceleration until the back door stops, if the controller detects a stop command for stopping the back door when automatic opening and closing control is being executed. According to a door opening and closing device according to the disclosure, by stopping a back door while decelerating the back door at a predetermined deceleration, an effect of being able to suppress rattling of the back door is able to be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door opening and closing device, comprising:

a motor configured to output driving force that causes a back door of a vehicle to be opened or closed; and a controller configured to control the motor, wherein the controller executes, according to an automatic opening and closing command, automatic opening and closing control for automatically opening or closing the back door from a first position to a second position by the motor, the first position being a door position at which the automatic opening and closing control is started, the second position being a door position at which the automatic opening and closing control ends, when the controller, during a movement of the back door from the first position to the second position under the automatic opening and closing control, detects a stop command causing the back door to be stopped at a third position between the first position and the second position, the controller decreases target velocity of the back door at a constant deceleration from a time of a detection of the stop command until the back door stops at the third position, the controller, according to the automatic opening and closing command, further controls the motor to decrease the target velocity of the back door at a predetermined deceleration from a fourth position to the second position, the fourth position is disposed between the first position and the second position, and a deceleration rate of the constant deceleration is higher than a deceleration rate of the predetermined deceleration.

2. The door opening and closing device according to claim 1, wherein the constant deceleration is set depending on an inclination of the vehicle in a front-back direction.

3. The door opening and closing device according to claim 1 wherein the constant deceleration is set depending on an environmental temperature.

4. The door opening and closing device according to claim 2 wherein the constant deceleration is set depending on an environmental temperature.

* * * * *